US008759081B2

(12) United States Patent
Klaunick et al.

(10) Patent No.: US 8,759,081 B2
(45) Date of Patent: Jun. 24, 2014

(54) MICROFLUIDIC ELEMENT WITH MULTI-FUNCTIONAL MEASURING CHAMBER FOR THE ANALYSIS OF A FLUID SAMPLE

(71) Applicant: Roche Diagnostics Operations, Inc., Indianapolis, IN (US)

(72) Inventors: Christoph Klaunick, Saarbruecken (DE); Romi Roedl, Mutterstadt (DE); Daniel Rohleder, Ladenburg (DE); Valerie Winckler-Desprez, Ladenburg (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 0 days.

(21) Appl. No.: 13/629,905

(22) Filed: Sep. 28, 2012

(65) Prior Publication Data

US 2013/0023060 A1 Jan. 24, 2013

Related U.S. Application Data

(63) Continuation of application No. PCT/EP2011/054069, filed on Mar. 17, 2011.

(30) Foreign Application Priority Data

Mar. 31, 2010 (DE) ..... 10 2010 013 752

(51) Int. Cl.
*C12M 1/34* (2006.01)
*B01L 3/00* (2006.01)

(52) U.S. Cl.
CPC ..... *B01L 3/5027* (2013.01)
USPC ..... 435/288.4; 422/502; 422/503; 435/288.5; 435/288.7

(58) Field of Classification Search
None
See application file for complete search history.

(56) References Cited

U.S. PATENT DOCUMENTS 5,242,606 A 9/1993 Braynin et al.
7,894,071 B2 2/2011 Frese et al.

(Continued)

FOREIGN PATENT DOCUMENTS

EP 1547691 A1 6/2005
EP 1894617 A2 3/2008
WO 2007/091281 A1 8/2007

OTHER PUBLICATIONS

International Search Report issued Jun. 8, 2011, in Application No. PCT/EP2011/054069, 3 pages.

*Primary Examiner* — Chris L Chin
(74) *Attorney, Agent, or Firm* — Roche Diagnostics Operations, Inc.

(57) ABSTRACT

A test element, analytical system and method for optical analysis of fluid samples is provided. The test element has a substrate and a microfluidic channel structure, which is enclosed by the substrate and a cover layer. The channel structure has a measuring chamber with an inlet opening. The test element has a first level, which faces the cover layer, and a second level, which interconnects with the first level such that the first level is positioned between the cover layer and the second level. A part of the measuring chamber extending through the first level forms a measuring zone connecting with a part of the measuring chamber that extends partially into the second level, forming a mixing zone. Optical analysis of fluid samples is carried out by light guided through the first level parallel to the cover layer, such that the light traverses the measuring zone along an optical axis.

16 Claims, 4 Drawing Sheets

(56) References Cited

U.S. PATENT DOCUMENTS

2002/0047003 A1 4/2002 Bedingham et al.
2004/0110275 A1 6/2004 Sandell
2009/0191643 A1 7/2009 Boehm et al.
2010/0291588 A1 * 11/2010 McDevitt et al. ..... 435/7.2

* cited by examiner

MICROFLUIDIC ELEMENT WITH MULTI-FUNCTIONAL MEASURING CHAMBER FOR THE ANALYSIS OF A FLUID SAMPLE

CROSS-REFERENCE TO RELATED APPLICATIONS

This application is a continuation of International Application No. PCT/EP2011/054069, filed 17 Mar. 2011, which claims the benefit of German Patent Application No. 102010013752.9, filed 31 Mar. 2010, the disclosures of which are hereby incorporated by reference in their entirety.

BACKGROUND

The present disclosure relates to microfluidic elements and, in particular, test elements for the optical analysis of a fluid sample with a substrate and a microfluidic channel structure that is enclosed by the substrate and a cover layer. The channel structure exhibits a measuring chamber with an inlet opening for the fluid sample.

In diagnostic tests (in vitro diagnostics), microfluidic elements are used to analyze a liquid sample and to thoroughly mix a fluid with a reagent. Body fluids are tested for an analyte contained therein for medical purposes. For this purpose, the fluid is mixed with a reagent, for example a liquid reagent. If the reagent is a solid, it is dissolved and homogenized by the fluid.

Measuring chambers of this type constructed as detection cuvettes are known. They are preferably inserted into rotary test elements or centrifugal test carriers (disks). The necessary steps of a method are carried out in the fluid structures of the test elements in order to carry out the appropriate reactions to detect an analyte in a fluid.

Both rotary and also non-rotary test carriers or test elements each have a microfluidic channel structure to accommodate a fluid sample. The channel structures often comprise a plurality of chambers so that complex, multi-step test procedures (test protocols) can be carried out. Such test carriers, as a rule, have at least one, frequently a plurality of fluid channel structures so that a plurality of tests can be carried out in parallel.

In so-called dry chemical test elements, the reagents required for the tests are initially introduced into the reagent chamber in the liquid form and dried therein. The reagent is normally dissolved using the fluid sample. After dissolving and thorough mixing in order to produce a homogeneous fluid sample, the mixed fluid is directed via further channels from the reagent and mixing chamber into an analysis or measuring chamber, where evaluation of the fluid sample takes place in order to detect and determine a specific analyte in the sample.

The sample fluid reacts with the reagent in the test element, resulting in a change in a measured parameter that has a definite relationship with the test analyte. This change in the measured parameter is measured in the test carrier itself. In addition to electrochemical evaluation methods, optical evaluation methods are routine, in which a change in color or other optically measurable parameter is detected.

There is a need in the art for test carriers that, before the measurement, mix the sample fluid as homogeneously as possible with the desired reagents. At the same time, the test elements and microfluidic channel structures employed are becoming ever more compact in order to produce as many parallel channel structures as possible on one test carrier.

SUMMARY

It is against the above background that the embodiments of the present disclosure provide certain unobvious advantages and advancements over the prior art. In particular, the applicant has recognized a need for improvements in microfluidic elements with multi-functional measuring chamber for analysis of fluid samples.

In accordance with one embodiment of the present disclosure, a microfluidic test element is provided comprising a substrate and a microfluidic channel structure that is enclosed by the substrate and a cover layer. The channel structure comprises a measuring chamber with at least one inlet opening. The test element has a first level, which faces the cover layer and in which the optical analysis of the fluid sample is carried out, and a second level, which interconnects with the first level in such a manner that the first level is disposed between the cover layer and the second level. A part of the measuring chamber that extends through the first level forms a measuring zone that connects to a part of the measuring chamber extending at least in part into the second level that constitutes a mixing zone. The mixing zone disposed in the second level has a rounded floor. Two optical deflection devices are disposed in the first level by means of which, for the optical analysis of the fluid sample, light incident upon the test element is deflected such that the light is deflected through the first level essentially parallel to the cover layer and traverses the measuring zone of the measuring chamber along an optical axis. The incident light is deflected parallel to the cover layer by means of the first deflection device and is guided out of the test element by means of the second deflection device.

In accordance with another embodiment of the present disclosure, an system for the optical analysis of a fluid sample is provided comprising an analytical unit and a test element, wherein the analytical unit comprises a holder to retain the test element, a measuring and evaluation device, an optical receiver and an optical emitter to emit light. For optical analysis, the test element comprises a substrate and a microfluidic channel structure enclosed by the substrate and a cover layer, wherein the channel structure comprises a measuring chamber with at least one inlet opening. The test element has a first level, which faces the cover layer and in which the optical analysis of the fluid sample is carried out, and a second level, which interconnects with the first level in such a manner that the first level is disposed between the cover layer and the second level. A part of the measuring chamber that extends through the first level forms a measuring zone that connects to a part of the measuring chamber extending at least in part into the second level that forms a mixing zone. Light used for the optical analysis of the fluid sample is guided through the first level essentially parallel to the cover layer such that the light traverses the measuring zone of the measuring chamber along an optical axis. The mixing zone disposed in the second level has a floor that is structured such that the floor is rounded.

In accordance with yet another embodiment of the present disclosure, a method for the optical analysis of a fluid sample is provided, comprising: providing a test element having a substrate and a microfluidic channel structure, which is enclosed by the substrate and a cover layer and which comprises a measuring chamber with at least one inlet opening, wherein the test element has a first level, which faces the cover layer, and a second level, which is interconnected with the first level such that the first level is disposed between the cover layer and the second level and wherein a part of the measuring chamber that extends through the first level forms a measuring zone that connects to a part of the measuring chamber that extends at least in part into the second level that constitutes a mixing zone and has a rounded floor. The method further comprises allowing the fluid sample to flow through the inlet opening into the measuring chamber; filling the mixing zone and the measuring zone with the fluid sample; providing a reagent that is contained in the mixing zone; mixing the fluid sample homogeneously with the reagent in the measuring zone and the mixing zone; introducing light into the test element for optical analysis of the fluid sample in a manner such that the light is guided through the first level essentially parallel to the cover layer and the light traverses the measuring zone of the measuring chamber along an optical axis; decoupling the light in a manner such that it exits the test element; and receiving and evaluating the light from an optical receiver of a measuring and evaluating device of an analytical unit.

These and other features and advantages of the embodiments of the present disclosure will be more fully understood from the following detailed description taken together with the accompanying claims. It is noted that the scope of the claims is defined by the recitations therein and not by the specific discussion of features and advantages set forth in the present description.

BRIEF DESCRIPTION OF THE DRAWINGS

The following detailed description of the embodiments of the present disclosure can be best understood when read in conjunction with the following drawings, where like structure is indicated with like reference numerals and in which.

Figure 1:
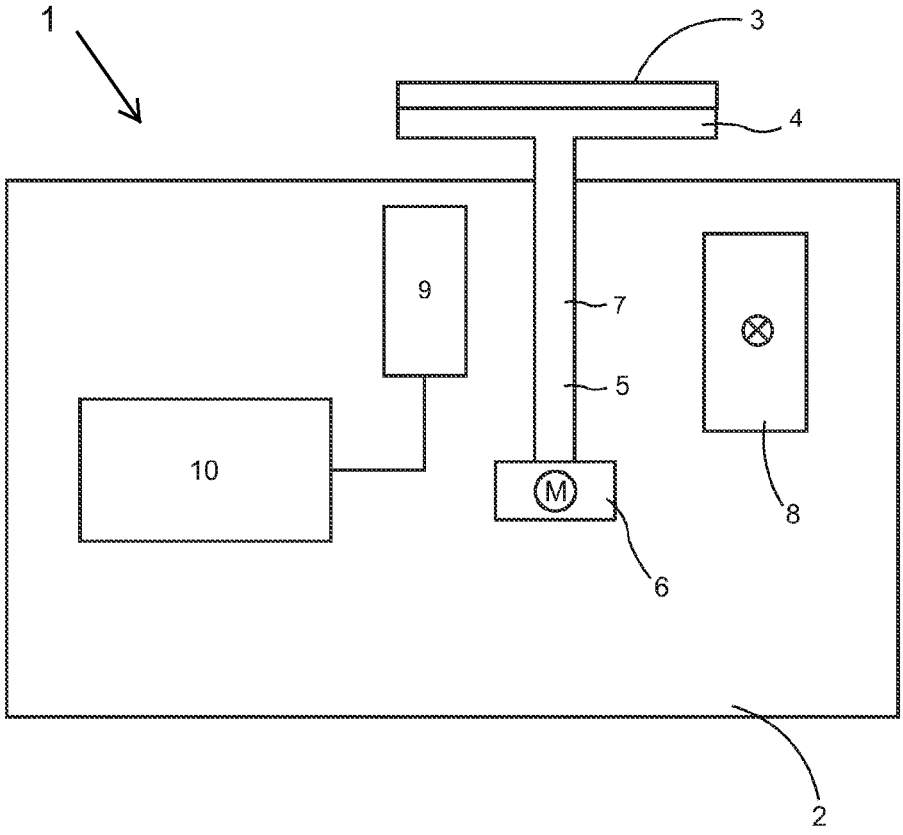
FIG. 1 shows a schematic representation of an analytical system with a test element and an analytical unit with a holder for the test element in accordance with an embodiment of the present disclosure.

Skilled artisans appreciate that elements in the figures are illustrated for simplicity and clarity and have not necessarily been drawn to scale. For example, the dimensions of some of the elements in the figures may be exaggerated relative to other elements to help improve understanding of the embodiments of the present disclosure.

DETAILED DESCRIPTION

Test carriers and fluid elements consist of a carrier material, normally a substrate formed from plastics material, which in the case of an optical evaluation method is at least partially transparent or opaque at least in the region of the measuring chamber. Examples of suitable materials are COC (cyclo-olefin-copolymer) or plastics such as PMMA, polycarbonate, polystyrene or polyimide.

The test elements have a channel structure that is enclosed by the substrate and a lid or a cover layer. The channel structure, which consists of a succession of a plurality of channel sections and expanded chambers, is defined by the structuring of the substrate or carrier material.

Controlled movement of the sample fluid in the microfluidic test elements is accomplished by producing an external force that acts on the fluid. This force may be produced by moving the test element, for example by rotation about a rotational axis or by a translational movement. If the test element is stationary, driving forces may be produced, for example by introducing compressed air into the channel structure or by hydrostatic forces. In addition, capillary forces may act which could be used in dependence on the structures employed for the purposes of control.

Detecting analytes in the fluid may be carried out using immunological detection methods. Other detection methods for the detection of ingredients in a fluid sample could also be used. The detection reaction may also take place on a solid phase on which the reagents required for detection are present and immobilized. When immunological detection methods are used, binding antibodies, for example, may be present and immobilized on the surface of the appropriate measuring chamber.

The microfluidic test element according to the present disclosure for the optical analysis of a fluid sample comprises a substrate with a microfluidic channel structure that is enclosed by the substrate and a cover layer or a lid. The substrate consists of a plastics material that is typically transparent or opaque in such a manner that optical detection of an analyte in the fluid sample can be carried out. Typically, the substrate is a moldable plastics material. It is simple and relatively inexpensive to manufacture, which still enabling the desired high precision structures (channel structures) to be produced. Examples of suitable molding methods are injection molding methods, hot stamping or other methods for the production of a unitary molded part. Alternatively, methods that remove material may be used, for example milling.

The channel structure of the test element comprises a multifunctional measuring chamber with at least one inlet opening to which an inflow channel, which also forms part of the channel structure, is connected. Typically, the measuring chamber is positioned at the end of the channel structure in the direction of flow of the fluid.

The test element has a first level, which faces the cover layer. Typically, the first level extends parallel to the upper surface of the substrate and parallel to the cover layer. In the first level, optical analysis of the fluid sample is carried out to determine an analyte contained therein. The test element has a second level that connects to the first level in a manner such that the first level is positioned between the cover layer and the second level.

The measuring chamber comprises a measuring zone and a mixing zone, wherein the measuring zone is formed by that part of the measuring chamber that extends through the first level. The mixing zone of the measuring chamber is formed by that portion of the measuring chamber that extends in the second level. Typically, the measuring zone and the mixing zone are positioned with respect to each other such that they are mutually aligned perpendicular to the cover layer. The mixing zone of the measuring chamber positioned in the second level has a floor that is structured such that it is rounded. The light used for optical analysis of the fluid sample is directed along an optical axis through the measuring zone of the measuring chamber. The light is thereby typically guided through the first level parallel to the cover layer respectively to the upper surface of the substrate. In doing so, that part of the fluid that is in the measuring zone of the measuring chamber is optically analyzed. The portion of the fluid positioned in the mixing zone is not analyzed. Thus, it is vital for all of the fluid to be homogeneously and thoroughly mixed. Thorough mixing of the fluid sample does not occur exclusively in the mixing zone that here is defined geometrically, but also in the neighboring measuring zone that, as regards the mixing function, forms a unitary zone.

The measuring chamber according to the present disclosure has the advantage that not only optical measurement is carried out therein. The measuring chamber also assumes even more functions that are necessary for the detection of ingredients in fluids. These functions may, for example, be mixing and thorough mixing of fluids or dissolving reagents in fluids. An adapted geometrical structure for the measuring chamber with a rounded floor of the mixing zone provides a reliable mixing of the fluids. It is thus not absolutely necessary to provide further chambers within the channel structure in which reagents are dissolved or fluids are mixed together such that they are in a homogeneous form. Combining the mixing and measuring functions in the measuring chamber in the form of a multifunctional measuring chamber saves a substantial amount of space on the test element.

In a typical embodiment, a reagent is positioned in the measuring chamber to detect a test analyte of the fluid sample. Typically, the reagent is in the solid form, i.e., it has dried up. In order to introduce the reagents into the mixing zone, either the cover layer is removed from the substrate or the liquid reagent is introduced during manufacture into the still open microfluidic channel structure without a cover layer.

Since reagents typically exhibit strong wetting characteristics, it was realized in the context of the present disclosure that the mixing zone of the measuring chamber has to be shaped such that on the one hand it is possible to introduce and dry out the reagent, and on the other hand the dried reagent can be re-suspended and homogenized properly. In addition, thorough mixing of fluids must be rapid and of high quality.

In the context of the present disclosure, it has been realized that a measuring chamber with rounded floor in the mixing zone is not only advantageous for thorough mixing or re-suspending of the reagents. The absence of sharp edges and corners prevents the reagents present in the liquid phase from leaving the cavity due to large capillary forces in corners of the measuring chamber and thus being partly lost to the reaction. In particular, on plastics surfaces, many reagents which have to be dried out exhibit strong wetting characteristics. In a typical embodiment, the measuring zone of the measuring chamber thus has a rounded upper border.

In a typical embodiment, the mixing zone may comprise further structural elements in order to accelerate thorough mixing. These may, for example, be barriers, ridges and depressions or similar geometric entities. The additional barriers should also join up with the upper surface of the mixing zone without any edges, so that the distribution of the reagent when it is drying out is as uniform as possible.

In a typical embodiment, the floor of the mixing zone is a segment of a sphere, typically a half sphere. Typically, the floor of the mixing zone is formed as a segment of a sphere or half sphere. The floor of the mixing zone may have an oval, elliptical or part-circular cross section.

In a typical embodiment, the measuring chamber is constructed such that the dried up reagent therein is positioned only in the mixing zone of the measuring chamber. Because of the shape of the measuring chamber, despite their strong wetting characteristics, they do not reach the measuring zone of the measuring chamber. Because of the two-part layered construction of the test element with an upper, first level, which is also termed the detection level and in which the analytes are measured, and a second level in which the structures for drying out and mixing the fluid are present, located underneath the first level, there is a clear separation between measuring on the one hand and mixing/drying/dissolving of the reagents on the other hand. The drying structures are integrated into depressions within the measuring chamber that are positioned outside the path of the measuring beam of the light for optical measurement. Interruptions to the measurement, for example because of dried out reagents, are thus avoided in a fail-safe manner.

The concept of the test element according to embodiments of the present disclosure thus provides a measuring chamber that integrates a plurality of functions. Since the measuring chamber is typically positioned at the end point of the path of flow of the fluid, mixing of the fluid with the reagents occurs time-wise before and/or during the measurement. Volume and reagent losses on the way through the channel structure into the measuring chamber are avoided. The channel structure is highly compact since a plurality of functions are combined in the measuring chamber, and so a plurality of channel structures can be integrated into or positioned in a mutually parallel manner on one test element. By integrating additional structures in the mixing zone, homogenization of the reagents with the liquid medium can be further accelerated and improved. Furthermore, advantageously adapted venting structures may be provided in the measuring chamber. Furthermore, the measuring chamber according to the present disclosure allows fail-safe investigations to be carried out with one and the same measuring device, since the optical path is not interrupted. One possible fail-safe feature is, for example, checking for correct and complete filling of the measuring chamber by phased determination of the absorption or another optical parameter before during and after completing the procedure for filling the measuring chamber with fluid.

It is also possible to carry out measurements during re-suspension of the dried up reagents so that the mixing behavior of the various fluids in the measuring chamber can be observed. The measuring chamber according to the present disclosure also enables continuous or semi-continuous (at intervals) measurement to be carried out.

Optical measurement is carried out in the measuring chamber according to the present disclosure at the first level, in the measuring zone of the chamber along an optical axis. The term "optical axis" should be understood to mean a straight line along which the beam of light passes for optical analysis. In a typical embodiment, the light beam is directed through the measuring zone in a manner such that it is aligned with the longitudinal axis of the measuring zone. The largest measurement of the measuring zone of the measuring chamber perpendicular to the normal to the face of the cover layer is designated as the longitudinal axis. The longitudinal axis thus passes essentially parallel to the first level of the test element. In a typical embodiment, the measuring chamber is a measuring cuvette (also termed a detection cuvette) with two parallel walls sitting one opposite the other that are oriented perpendicular to the cover layer and to the optical axis. Light can therefore enter the measuring zone and exit from the opposite side wall with as little scattering as possible. Typically, the measuring zone and the mixing zone together form the measuring or detection cuvette.

In principle, the test element according to the present disclosure can be inserted into any type of test carrier. As an example, these test elements can be used in test strip-like fluid devices. However, they can also be integrated into detection cassettes with channel structures. Particularly typically, the test element according to the present disclosure can be used as a centrifugal test carrier that rotates about a rotational axis. Rotation of the test element then controls the movement of the fluid. Alternate acceleration and deceleration of the rotation (known as the shake mode as described, for example, in EP 1 894 617 A2) results in rapid thorough mixing and dissolution of the dried reagents.

Particularly with complex fluid systems, which are frequently employed in centrifugal test carriers and rotary test elements, the quantity of fluid mixture to be analyzed frequently cannot be reliably controlled. In the context of the present disclosure, it was realized that again and again, variations occurred in the filled height of the measuring chamber. In an advantageous embodiment, the measuring chamber thus comprises an antechamber in which the inlet opening is positioned. The antechamber is positioned in the first level of the test element and it is at most as high as the height of the first level perpendicular to the cover layer. The antechamber is separate from the measuring zone and the mixing zone, i.e., the measuring cuvette of the measuring chamber, but there is a fluid connection between them. In this manner, excess fluid can be trapped and stored in the antechamber. The volume of fluid to be tested in the measuring zone can thus be kept constant even when the measuring cuvette or the measuring chamber is "over-filled".

In the context of the present disclosure, it was realized that when dissolving the dried out reagents in the measuring chamber, air bubbles and foam are occasionally formed. This bubble formation can affect the accuracy/reliability of the results of the analysis, as it can disrupt the optical measurement. Typically, the measuring chamber has a venting opening that opens into a venting channel. The venting channel can allow air to escape from the measuring chamber. Typically, the venting opening is positioned in the antechamber of the measuring chamber.

In a typical embodiment, the measuring chamber has a plateau between the measuring zone and the inlet opening with a plateau zone between the plateau and the cover layer. The height of the plateau zone perpendicular to the cover layer is less than the height of the measuring zone of the measuring chamber. The plateau is positioned in the first level of the test element. Particularly typically, the plateau is positioned between the antechamber and the measuring zone of the measuring chamber. The plateau enables air to reach the venting opening without letting fluid flow back into the inlet opening. In this manner, it is possible for air bubbles formed in the measuring zone to be guided into the antechamber. The measuring zone thereby remains free of air bubbles. This ensures reliable measurement within the measuring zone.

With a rotary test element, the antechamber is positioned such that its distance to the rotational axis is less than the distance of the measuring zone of the measuring chamber to the rotational axis. In this manner, rotation of the test element forces the fluid, which is denser than air, into the measuring zone that is remote from the rotational axis, while the "lighter" air arrives in the antechamber, which is closer to the rotational axis. The terms "remote from the rotational axis" and "further from the rotational axis" or "close to the rotational axis" or "closer to the rotational axis" refer to the relative position of an element compared with the other element with respect to the rotational axis. Thus, an element that is remote from the rotational axis is at a greater distance from the rotational axis than another element, and an element that is close to or closer to the rotational axis is at a smaller distance to the rotational axis than another element.

The present disclosure further relates to an analytical system for the optical analysis of a fluid sample, comprising an analytical unit and a test element. The analytical unit of the present disclosure has a holder to hold the test element and a measuring and evaluation device. It comprises an optical emitter to emit light and an optical receiver to receive light. The test element according to the present disclosure for optical analysis has a substrate and a microfluidic channel structure that is enclosed by the substrate and a cover layer.

In a typical embodiment, the holder for the analytical unit is rotatable about a rotational axis. The test element retained in the holder rotates about the rotational axis of the analytical unit holder. Typically, the rotational axis is positioned in a manner such that it passes through the retained test element.

In a typical embodiment, the analytical system is constructed such that optical analysis of a fluid sample is carried out during rotation of the test element. The light emission is thus pulsed. The light emitter of the analytical unit thus constantly emits light when the test element is positioned in a position in which the emitted light passes along the optical axis through the measuring zone of the measuring chamber until it is received at the optical receiver and can then be evaluated using the measuring and evaluation unit.

Optical analysis of a fluid sample is carried out automatically or semi-automatically using the method according to the present disclosure. Initially, a test element according to an embodiment of the present disclosure is provided. In a further step, the fluid sample for testing is allowed to flow through the inlet opening into the measuring chamber. Next, the mixing zone and the measuring zone of the measuring chamber are filled and a reagent is provided that is contained in the measuring chamber. The reagent has typically been dried out. In the next step, the fluid sample is homogeneously mixed with the fluid sample. Alternatively, if there is no reagent in the mixing zone, the fluid sample is homogeneously distributed and mixed in the measuring zone and the mixing zone. Optionally, it is also possible to mix the two fluids together homogeneously.

In a further step, light for the optical analysis of the fluid sample is directed into the test element. The light is thus guided essentially parallel to the cover layer of the test element through the first level so that it passes through the measuring zone and the measuring chamber along an optical axis. In this manner, the light is guided through the fluid sample contained in the measuring zone.

In a further step, light is decoupled from the test element so that it exits the test element. The light is then received and evaluated by a measuring and evaluation device of an analytical unit. The type of optical measurement wherein the measuring light beam is guided through the measuring zone in a plane essentially parallel to the upper side of the test element is termed "in-plane detection".

Homogeneous mixing of the fluid sample, which is typically a body fluid such as blood or plasma, with a reagent thus occurs in the same measuring chamber as measuring and analysis of the mixed fluid. It is not necessary to transport the fluid to another chamber after mixing. This has the advantage that the measurement can be carried out more rapidly; in addition, no fluid is lost by wetting further microfluidic channel structures during transport of a fluid.

In a typical embodiment of the method according to the present disclosure, light is emitted, by means of an optical emitter, perpendicular to the cover layer of the test element. Using a first deflection device, the light is deflected such that it is guided through the first level parallel to the cover layer. After traversing the measuring zone with the fluid sample, the light is deflected once again perpendicular to the cover layer by means of a further deflection device such that the light can be received by an optical receiver of the analytical unit.

In a typical embodiment of the method according to the present disclosure, the method is automatically carried out by means of an analytical unit wherein initially, the test element is retained in a holder of the analytical unit. The movement of the fluid sample in the test element is controlled by rotation of the test element about a rotational axis, which is the same as the rotational axis of the holder of the test element. Thus, the fluid sample is introduced into the measuring chamber by rotation of the test element. It is also possible to drive the test element in "shake-mode", whereupon it is alternately accelerated and braked.

Typically, emission and receipt of light is carried out during rotation of the test element. The optical analysis of the fluid sample thus is carried out while the test element turns in the holder of the analytical unit. Typically, the light is thus pulsed, for example by means of a stroboscope.

In a particular embodiment, the measuring chamber of the test element comprises an antechamber. While the method according to the present disclosure is being carried out, the air contained in the measuring chamber is forced into the antechamber by driving the fluid so that the measuring zone and the mixing zone of the measuring chamber are filled with the desired quantity of fluid. Excess fluid is thereby directed out of the measuring zone and the mixing zone into the antechamber.

In order that the embodiments of the present disclosure may be more readily understood, reference is made to the following particular embodiments shown in the figures in more detail, which are intended to illustrate the embodiments of the disclosure, but not limit the scope thereof. The particular features disclosed therein may be used individually or in combination in order to produce typical embodiments of the disclosure. For clarification and illustration of the embodiments of the disclosure, the test element is described with the aid of a rotational test element; all features and particulars described for it, insofar as they do not refer explicitly to a rotational test element, may also be employed with non-rotational, translationally displaced or stationary, non-moving test elements. The exemplary embodiments described do not limit the disclosure as defined in general in the claims.

FIG. 1 shows an analytical system 1 in accordance with an embodiment of the disclosure with an analytical unit 2 and a test element 3. The analytical unit 2 comprises a holder 4 in which the test element 3 is retained. In the particular embodiment illustrated schematically here, the holder 4 is rotatable about a shaft 5 that is driven by a motor 6. The rotational axis 7, which is coaxial with the shaft 5, in the present case passes through the test element 3. Clearly, analytical unit 2 can also be envisaged wherein the holder 4 for the test element 3 is fixed. Equally, instead of a rotational movement, a translational movement may be executed.

In accordance with the present disclosure, the analytical unit 2 comprises an optical emitter 8, an optical receiver 9 and a measuring and evaluation device 10. The optical emitter comprises, for example, an LED or another light source. It emits light or other electromagnetic radiation. The emitted light may be in the visible or non-visible region and may include X-rays or other electromagnetic radiation. The non-limiting term "light" will be used hereinafter. The light is guided such that it is directed through the test element until it finally reaches the optical receiver 9. The receiver 9 may be a photodiode or a plurality of same. The signal detected at the receiver 9 is evaluated by means of the measuring and evaluation device 10 so that an analyte or its concentration in a fluid in the test element 3 can be determined.

Figure 2:
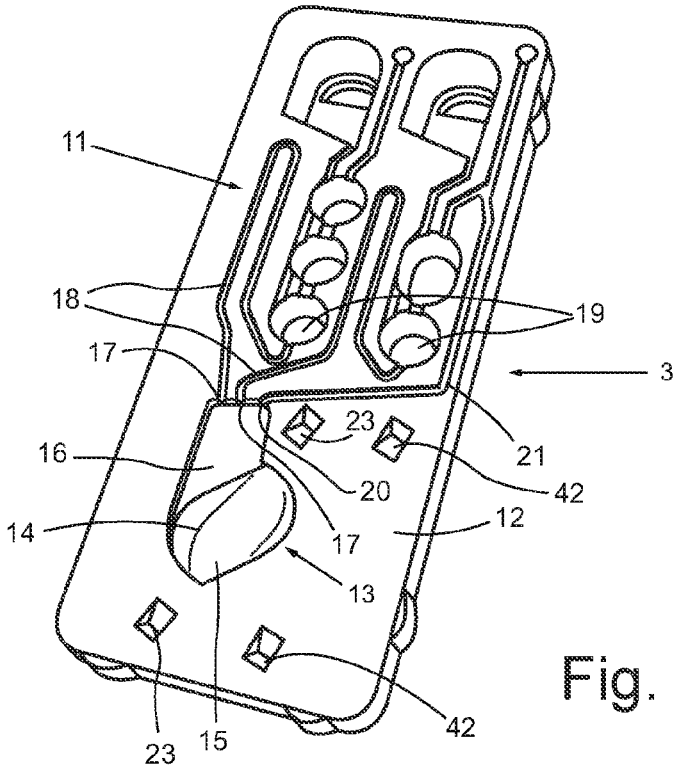
FIG. 2 shows a first embodiment of a test element in accordance with the present disclosure.

FIG. 2 shows a particular embodiment of a test element 3 in accordance with the disclosure with a microfluidic channel structure 11 that has a plurality of chambers and channels. The test element 3 comprises a substrate 12 that consists of a transparent or opaque plastics material. The substrate 12 is typically opaque or transparent so that optical measurements are possible. The properties and the degree of transparency of the substrate will depend on the light employed for the optical measurement.

The channel structure 11 is enclosed by the substrate 12 and a lid or cover layer that is not shown in the figures. At the end of the channel structure 11 is a measurement chamber 13, which comprises a measuring zone 14, a mixing zone 15 and a plateau 16. The mixing zone 15 and the measuring zone 14 in this case are in the shape of an American football (rotational ellipsoid) and have an oval cross section. The measuring chamber 13 has two inlet openings 17, which are connected to channels 18, which themselves end in further chambers 19 of the channel structure. The measuring chamber 13 comprises a venting opening 20, which is connected to a venting channel 21 and through which air contained in the measuring chamber 13 can escape.

Figure 3:
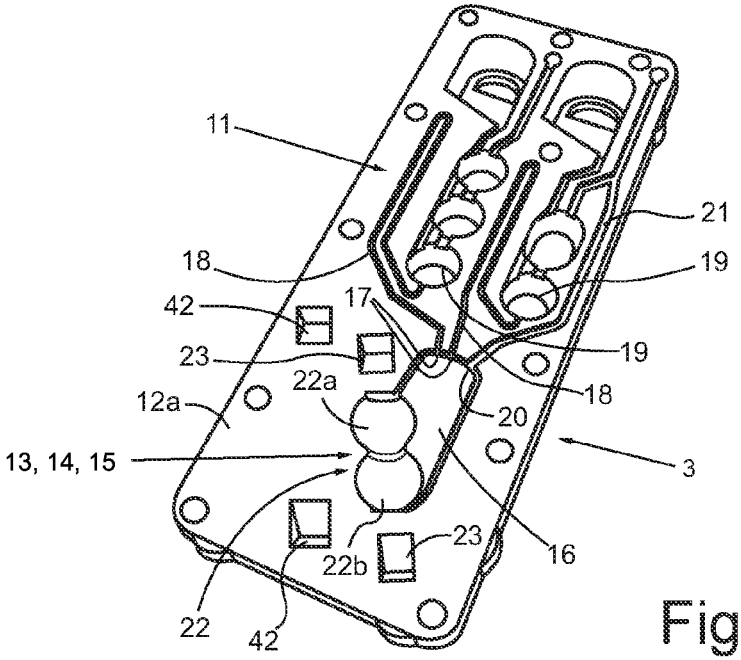
FIG. 3 shows a further embodiment of a test element in accordance with the present disclosure.

FIG. 3 shows an alternative embodiment of a test element 3 with a channel structure 11 with a measuring chamber 13 positioned at its end. The measuring chamber 13 again comprises two inlet openings 17 through which fluid can flow from the neighboring chambers 19 and intermediate channels 18 into the measuring chamber 13. The measuring chamber 13 has a venting opening 20 through which air can escape into the venting channel 21. A plateau 16 is positioned between the inlet opening 17 and the measuring zone 14.

The measuring chamber 13 of the test element 3 of the embodiment(s) of the present disclosure is typically shaped such that its measuring zone 14 is essentially cylindrical in shape, wherein the floor and cover surface of the cylindrical zone are essentially parallel to the plane of the cover layer. In a particularly typical embodiment, the measuring zone 14 is in the shape of a double cylinder 22 with two adjacent cylinders 22*a*, 22*b*. The cylinders 22*a*, 22*b* partially overlap (FIG. 3). Typically, a mixing zone portion is connected to each of the cylinders 22*a*, 22*b* of the measuring zone 14 perpendicular to the upper face 12*a* of the substrate in the direction facing away from the plane of the cover layer; the mixing zone portions together form the mixing zone 15.

In a typical embodiment, the test element 3 comprises two optical deflection devices 23, by means of which light incident upon the test element is deflected, so that the light is directed parallel to the cover layer or upper face 12*a* of the substrate through the measuring zone 14 of the measuring chamber 13 and out of the test element onto the receiver 9 by means of the deflection device which is connected optically downstream of the measuring chamber 14. FIGS. 2 and 3 each have two deflection devices 23 that are positioned such that the measuring zone 14 is positioned between the two deflection devices 23. The deflection devices 23 are shown in greater detail in FIG. 6. Further descriptions of deflection devices of this type are disclosed in U.S. Pat. No. 7,894,071 B2.

The optional additional deflection devices 42 beyond the measuring cuvette deflect light—in contrast to the deflection devices 23—not through the measuring zone 14 of the measuring chamber 13, but through zones outside the measuring chamber 13, for example through the substrate of the test element 3. These additional deflection devices 42 may in particular be used for reference measurements, for example in which their measurements can be compared with the measurements used for analyte determination (which are obtained via the deflection devices 23), in order to thereby accommodate and compensate for any fluctuations in the measurement system caused by the equipment. Alternatively a reference measurement may, for example, also be made by producing, before filling the measuring chamber 13, an initial value for the empty measurement chamber 13, which is used as a reference value for detecting the analyte with a filled measurement chamber 13.

The two test elements 3 of FIGS. 2 and 3 were used to optimize the measuring chamber 13. The measuring chamber 13 is multifunctional, acting on the one hand for measuring and determining an analyte in a fluid by means of an optical evaluation. On the other hand it should also have other functions, such as mixing fluids and dissolving reagents, for example. In the context of the tests, it was shown that a measuring chamber 13 with a cylindrical measuring zone 14 and an interconnecting mixing zone 15 with a rounded floor has improved properties.

Figure 4:
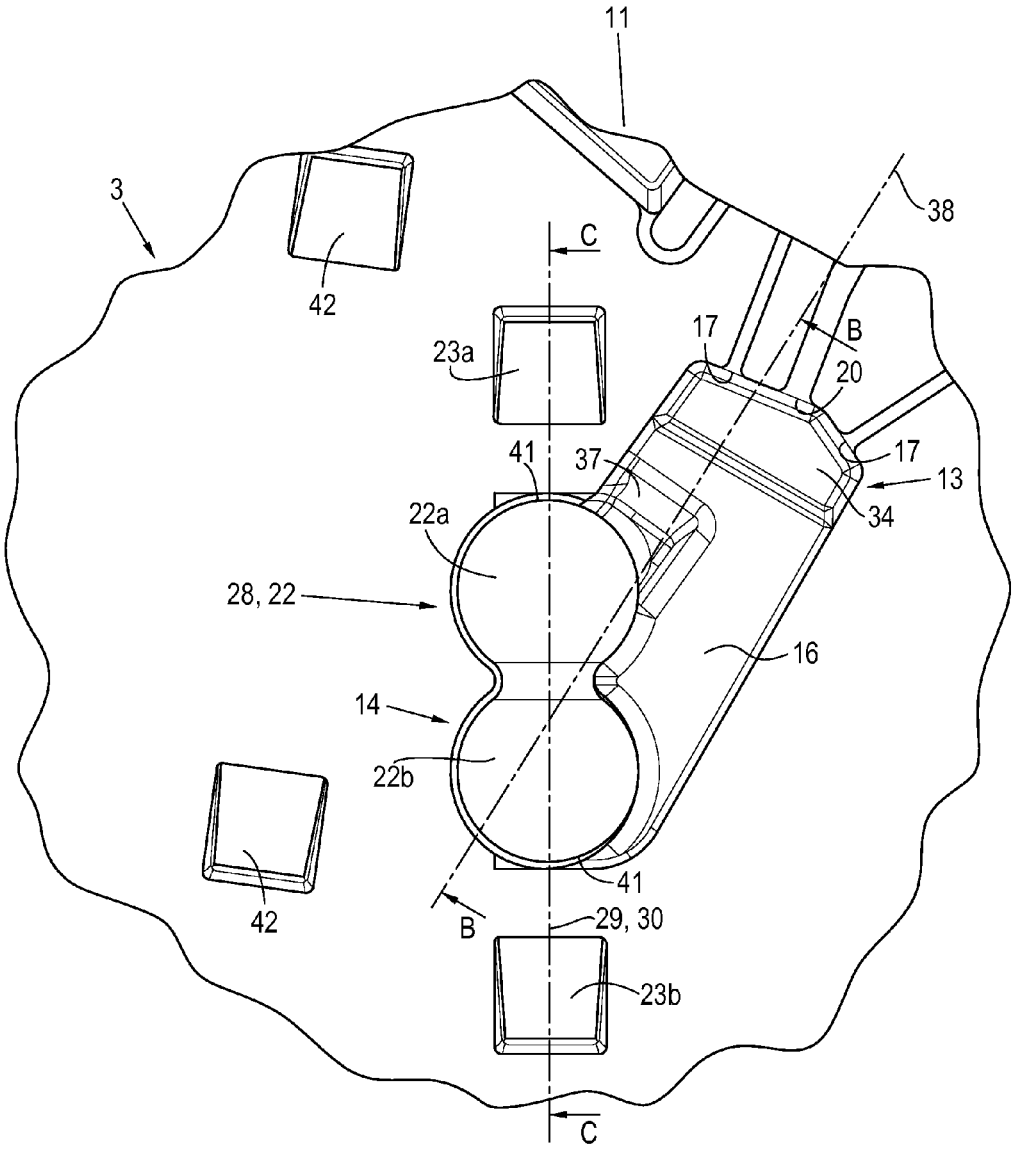
FIG. 4 shows a detail of a channel structure of a test element with a measuring chamber in accordance with an embodiment of the present disclosure.
Figure 5:
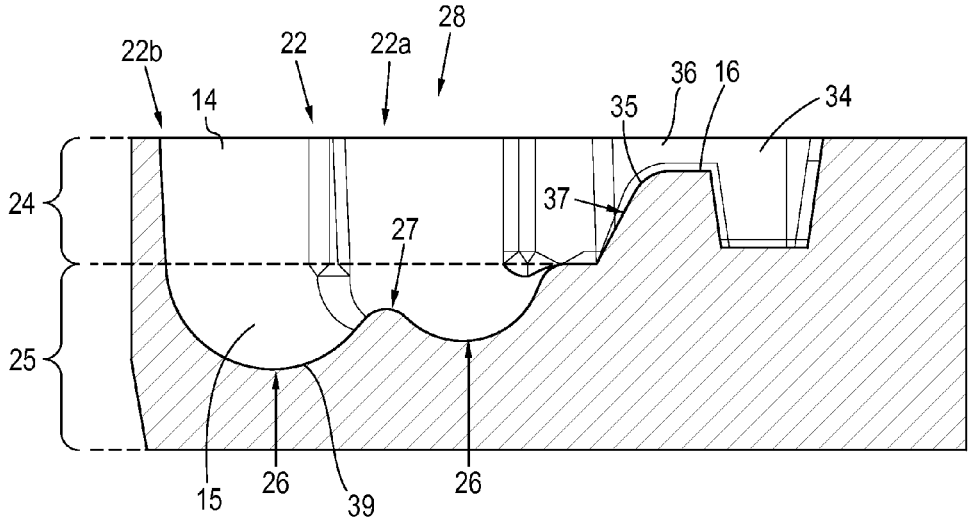
FIG. 5 shows a section through the test element of FIG. 4 along a line B-B.

FIG. 4 shows a detail of a channel structure 11 in top view. It shows the measuring chamber 13 and the two deflection devices 23 for the light used for analysis. FIG. 5 shows a section along the line B-B of FIG. 4, and FIG. 6 shows a section along the line C-C in FIG. 4.

Figure 6:
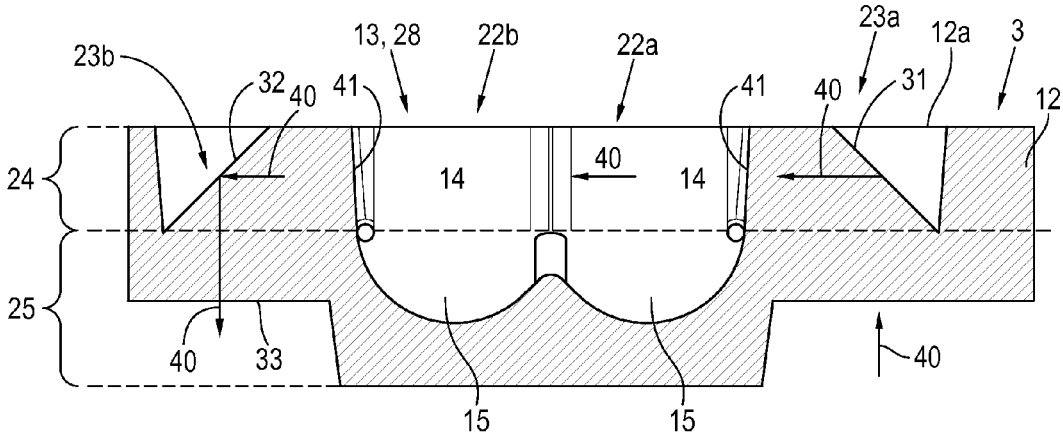
FIG. 6 shows a section through the test element of FIG. 4 along a line C-C.

With reference to FIGS. 5 and 6, the measuring chamber 13 has a measuring cuvette 28, which is formed by the measuring zone 14 that extends in a first level 24 of the test element 3, and the mixing zone 15, which is positioned under the measuring zone 14 in a second level 25 of the test element. The measuring zone 14 is thus the part of the measuring cuvette 28 that is positioned in the first level 24. The mixing zone 15 connects below the measuring zone 14 and constitutes the part of the measuring cuvette that extends in the second level 25. The measuring zone 14 and the mixing zone 15 are thus arranged one underneath the other to form the common zone of the measuring cuvette 28, and thus a fluid can move in both zones.

Thus, at its lower end in the second level 25 of the test element 3 the measuring cuvette 28 has a rounded floor 39 that is the floor 39 of the mixing zone 15.

At least two opposed side walls 41 of the measuring cuvette 28 are in the zone in which the light beam used for analysis enters and leaves the measuring cuvette, oriented essentially perpendicular to the upper side 12*a* of the substrate 12. This essentially perpendicular zone of the side walls 41 lies in the first level 24 of the test element. Typically, the side walls 41 of the measuring zone 14 are oriented parallel to the normal to the face of the upper side of the test element 3.

In a particular embodiment, the measuring cuvette 28 is in the form of a double cylinder 22 with two partially overlapping cylinders 22*a*, 22*b*. The cylinders 22*a*, 22*b* overlap so as to form a common measuring volume. The floor 39 of the double cylinder 22 is multi-rounded in this case. It is formed from two overlapping spherical segments 26, with the overlap 27 formed between the spherical segments 26 also being rounded (FIGS. 5, 6).

In the context of the present disclosure, it has been realized that forming the measuring cuvette 28 of the measuring chamber 13 as a double cylinder 22 for mixing of the fluid is of particular advantage. In each of the individual cylinders 22*a*, 22*b*, when the test element 3 is rotated, vortices, typically opposed, are formed. The vortices result in highly efficient and rapid mixing and re-suspension.

The two cylinders 22*a*, 22*b* are positioned such that the measuring cuvette 28 formed by the double cylinder 22 has a longitudinal extent that is oriented along a longitudinal axis 29. The longitudinal axis 29 coincides with an optical axis 30 of the measuring chamber 13. The optical axis is the path followed by light through the measuring chamber 13. Light (arrow 40) emitted by the optical emitter 8 of the analytical unit 2 is directed from the underside 33 of the test element 3 through the substrate 12 to a first interface 31 of the first deflection device 23*a* and is deflected so that it runs parallel to the upper side 12*a* of the substrate 12 or to the cover layer (not shown) of the test element 3. After entering through the side wall 41 and traversing the measuring zone 14 in the first level 24 of the test element 3, the light exits via the opposite side wall 41. The light is then deflected again at a second interface 32 of the second deflection device 23*b* so that it exits from the underside 33 of the test element and reaches the optical receiver 9 of the analytical unit 2. The beam of light (arrow 40) for optical analysis traverses only the measuring zone 14 but not the mixing zone 15, so that the optical analysis is now not affected if reagents deposited in the mixing zone 15 are not completely dissolved.

The advantage with making the optical measurement parallel to the upper side 12*a* of the test element 3 is that the light path is substantially longer. The necessary length of the light path is dependent on the concentration range of the analyte to be measured in the fluid. If this were to be carried out with a measurement perpendicular to the upper side 12 of the test element 3, the thickness of the test element 3 would have to be much greater. In the example shown, the thickness of the test element is approximately 4 mm. This would result in a higher consumption of material and it would be less convenient to handle.

The measuring chamber 13 is constructed such that the longitudinal extent of the measuring cuvette 28 along the longitudinal axis 29 is selected as a function of the concentration of the analyte to be measured. In the context of the present disclosure, a longitudinal extent of the measuring cuvette 28 in the range from at least about 4 mm to about 8 mm has proved advantageous, in particular a length of about 6 mm. The longitudinal extent of the measuring cuvette 28 is dependent on the analytes to be tested and the desired concentration range of the analytes.

The measuring chamber 13 has two inlet openings 17, through which the fluid enters the measuring chamber. Between the two inlet openings 17 for the fluid is a venting opening 20, through which air from the measuring chamber 13 can escape.

In a typical embodiment, the measuring chamber 13 comprises an antechamber 34, in which the inlet opening 17 is positioned. The antechamber 34 is positioned in the first level 24 of the test element 3. The height of the antechamber 34 perpendicular to the upper side 12*a* of the substrate 12 is typically less than the height of the first level 24. The height of the first level 24 is the extent of the first level 24 perpendicular to the upper side 12*a* of the substrate 12.

In a typical embodiment, as can be seen in FIG. 4, the antechamber 34 is positioned off the optical axis 30. A beam of light 40 for optical detection of an analyte in a fluid sample is not directed through the antechamber 34. The optical analysis is thus independent of any fluid that has collected in the antechamber 34.

In a further typical embodiment, a plateau 16 is positioned in the measuring chamber 13 between the inlet opening 17 and the measuring zone 14. A plateau zone 36 (see, FIG. 5) is formed between the plateau 16 and the cover layer, which cover layer is not shown in the figures; its height perpendicular to the upper side 12*a* of the test element 3 is less than the height of the measuring zone 14 and thus is also less than the height of the first level 24 of the test element 3. Typically, the height of the plateau zone 36 is also less than the height of the antechamber 34.

In a typical embodiment, for instance illustrated in FIG. 5, an inclined ramp 37 is positioned between the plateau 16 and the measuring zone 14, one end of which, that faces the measuring zone 14, is positioned at the interface between the first level 24 and the second level 25 at the measuring zone 14. Thus, one end of the ramp 37 is positioned at the transition between the measuring zone 14 and the mixing zone 15. Typically, the transitions from the measuring cuvette 28 to the ramp 37 and the transition from the ramp 37 to the plateau 16 are rounded. Fluid therefore cannot escape from the measuring cuvette 28 by capillary action.

In a further typical embodiment, the measuring chamber 13, in particular the cuvette 28, has only rounded shapes. Even an upper border 35 of the measuring zone 14, which forms a transition to the plateau 16, is rounded.

The ramp 37 extends between the plateau 16 and the radially inner cylinder 22*a* of the measuring cuvette 28. It is positioned such that the plateau 16 is L-shaped. In the present embodiment of the measuring chamber 13, the plateau 16 has a maximum length of approximately 6.6 mm and a maximum width at the transition to the antechamber 34 of approximately 3.3 mm. The disposition of the ramp 37 and rounding of the ends of the ramp 37 ensures that when re-suspending dried reagents in the mixing zone 15, air bubbles that are formed escape from the measuring cuvette 28, i.e., from the mixing zone 15 and the measuring zone 14 and are moved into the antechamber 34 of the measuring chamber 13. The rounded transitions of the ramp 37 improve the transport of air bubbles or built up foam, ensuring that the measuring cuvette 28 is free of air bubbles. This prevents bubble formation in the path of the beam from affecting the measurement or accuracy/reliability of the results of the measurements.

To provide a reliable measurement of an analyte in the fluid, it is important for the filling height in the measuring cuvette 28 to be constant. Because of the complex fluid system of the channel structure 11 of the rotary test element 3, the volumes to be examined cannot be kept completely constant. In tests, occasional fluctuations in the filling height in the measuring cuvette 28 occurred. In a typical embodiment, excess fluid volume can escape from the measuring cuvette 28. The excess fluid goes over the ramp 37 onto the plateau 16 and is collected in the antechamber 34. The fluid remains in the measuring chamber 13, however. In this manner, slight over-filling of the measuring cuvette 28 can be compensated for. In addition, the antechamber 34 allows the measuring chamber 13 to be filled in a manner that leaves air in the measuring chamber 13. In this manner, mixing of the fluids is improved. However, the measuring cuvette 28 is simultaneously filled completely.

The rotation of the test element 3 forces the fluid flowing into the measuring chamber 13 into the measuring cuvette 28, which is further from the rotational axis 7 with respect to the inlet opening 17. Since the inlet opening 17 is positioned on the upper border of the first level 24, the fluid flows away over the antechamber 34 directly into the measuring cuvette 28. Because of its lower density, air is forced out of the measuring cuvette 28 in the direction of the antechamber 34 and can escape through the venting opening 20.

Advantageously, the plateau 16 extends in the direction of the radial component 38 of the test element 3. The radial component 38 is the direction orientated from the rotational axis 7 to the outer border of the test element 3. In a typical embodiment, the measuring chamber 13 is constructed such that the longitudinal axis 29, which coincides with the optical axis 30, encloses an angle with the radial component 38 of the rotary test element 3 that is between about 20 degrees and about 40 degrees. Typically, the angle is at least about 25 degrees and at most about 35 degrees; more typically, the angle is about 30 degrees.

The cover layer of the test element 3 is positioned on the upper side 12*a* of the substrate 12. It is not shown in the accompanying figures. Like the substrate 12, the cover layer may itself be transparent or opaque. It may also be obscure, since light is coupled and decoupled via the underside 33 of the test element 3.

It is noted that terms like "preferably", "commonly", and "typically" are not utilized herein to limit the scope of the claimed subject matter or to imply that certain features are critical, essential, or even important to the structure or function of the embodiments disclosed herein. Rather, these terms are merely intended to highlight alternative or additional features that may or may not be utilized in a particular embodiment of the present disclosure.

It is also noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

It will be apparent to those skilled in the art that various equivalents, changes, and modifications may be made to the embodiments described herein without departing from the spirit and scope of the claimed subject matter. Thus it is intended that the specification cover the modifications and variations of the embodiments described herein provided such modifications and variations come within the scope of the appended claims and their equivalents.

What is claimed is:

1. A test element for use with an analytical unit with an optical emitter to emit light for the optical analysis of a fluid sample, comprising:

a substrate and a microfluidic channel structure that is enclosed by the substrate and a cover layer, wherein the channel structure comprises a measuring chamber with at least one inlet opening;

the test element has a first level, which faces the cover layer and in which the optical analysis of the fluid sample is carried out, and a second level, which interconnects with the first level in such a manner that the first level is disposed between the cover layer and the second level;

a part of the measuring chamber that extends through the first level forms a measuring zone that connects to a part of the measuring chamber extending at least in part into the second level that constitutes a mixing zone, wherein the mixing zone of the measuring chamber contains a reagent for detecting an analyte in the fluid sample that reacts with the fluid sample;

the mixing zone disposed in the second level has a rounded floor;

two optical deflection devices are disposed in the first level by means of which, for the optical analysis of the fluid sample, light incident upon the test element is deflected such that the light is deflected through the first level essentially parallel to the cover layer and traverses the measuring zone of the measuring chamber along an optical axis; and the incident light is deflected parallel to the cover layer by means of the first deflection device and is guided out of the test element by means of the second deflection device.

2. The test element of claim 1, wherein the reagent is in a solid form.

3. The test element of claim 2, wherein the reagent in solid form is dried in the mixing zone.

4. The test element of claim 1, wherein the measuring chamber comprises an antechamber in which the inlet opening is positioned, wherein the antechamber is positioned in the first level of the test element and the height of the antechamber is at most that of the height of the first level perpendicular to the cover layer.

5. The test element of claim 4, wherein the antechamber is positioned such that it is not intercepted by the beam of light for optical analysis of the fluid sample in the measuring chamber.

6. The test element of claim 1, wherein a plateau is positioned between the measuring zone of the measuring chamber and the inlet opening into the measuring chamber with a plateau zone formed between the plateau and the cover layer with a height perpendicular to the cover layer that is less than the height of the measuring zone of the measuring chamber.

7. The test element of claim 6 further comprising an inclined ramp positioned between the measuring zone and the plateau.

8. The test element of claim 7, wherein one end of the inclined ramp facing the measuring zone is positioned at the transition between the measuring zone and the mixing zone.

9. The test element of claim 1, wherein the floor of the mixing zone of the measuring chamber is in the form of a segment of a sphere.

10. The test element of claim 9, wherein the measuring chamber is half-spherical in shape.

11. The test element of claim 1, wherein the measuring chamber is positioned at the end of the channel structure in the direction of flow of a fluid.

12. The test element of claim 1, wherein the measuring chamber includes a measuring cuvette, which comprises the measuring zone and the mixing zone, wherein opposed side walls of the measuring cuvette are oriented essentially perpendicular to the cover layer in the region of the measuring zone.

13. The test element of claim 12, wherein the measuring cuvette of the measuring chamber is constructed in the shape of a cylinder.

14. The test element of claim 12, wherein the measuring cuvette is constructed in the form of a double cylinder with two adjacent cylinders, and wherein each cylinder has a rounded floor in the second level of the test element.

15. The test element of claim 14, wherein said two adjacent cylinders partially overlap.

16. The test element of claim 1, wherein the measuring chamber comprises a venting opening that is connected with a venting channel and through which the air contained in the measuring chamber can escape.

* * * * *